US005299445A

United States Patent [19]

Yee

[11] Patent Number: 5,299,445

[45] Date of Patent: Apr. 5, 1994

[54] METHOD OF POST-TENSIONING STEEL/CONCRETE TRUSS BEFORE INSTALLATION

[76] Inventor: Alfred A. Yee, 1441 Kapiolani Bl., Honolulu, Hi. 96814

[21] Appl. No.: 881,766

[22] Filed: May 12, 1992

Related U.S. Application Data

[63] Continuation-in-part of Ser. No. 708,712, May 31, 1991.

[51] Int. Cl.[5] ..... E04G 21/00

[52] U.S. Cl. ..... 52/745.19; 264/228; 52/223.8

[58] Field of Search ..... 14/9, 10; 52/174, 223 R, 52/640-643, 690, 694, 223.8, 223.9, 745.19; 264/228

[56] References Cited

U.S. PATENT DOCUMENTS

| | | | |
|---|---|---|---|
| 1,331,871 | 2/1920 | Mortenson | 52/174 |
| 1,718,883 | 6/1929 | Shodin | 52/644 |
| 2,712,750 | 7/1985 | Finsterwalder | 52/223 R |
| 4,391,637 | 7/1983 | Mosier | 52/640 |

FOREIGN PATENT DOCUMENTS

| | | | |
|---|---|---|---|
| 589547 | 12/1959 | Canada | 52/223.8 |
| 642128 | 6/1962 | Canada | 52/174 |

OTHER PUBLICATIONS

Engineering News, vol. 71, No. 43, p. 1232, Article Entitled "A Reinforced Concrete Truss Bridge, Las Vegas, N.M.", by George E. Morrison.

*Primary Examiner*—James L. Ridgill, Jr.

*Attorney, Agent, or Firm*—Jacobson, Price, Holman & Stern

[57] ABSTRACT

A method of post-tensioning a truss of substantially conventional steel construction provided with concrete encasement or cladding of certain chords while the truss is in a fabrication yard or at ground level before erection and installation in which the structural steel truss is first assembled in a fabrication yard with certain of the chords being provided with formwork. Reinforcing steel and steel tendons are placed in the formwork and concrete is poured to encase the chords of the truss while the truss is positioned horizontally or vertically in the fabrication yard or at ground level. The steel tendons are then partially or fully post-tensioned to provide maximum load support capability. The cladded and partially or fully post-tensioned truss is then lifted to an installation point and a load deck placed on the truss with final post tensioning of the truss then being completed. The truss of the present invention can be used in situations where trusses are used to carry heavy loads over long spans such as bridges, stadiums, convention halls and the like and is especially beneficial when spanning a busy highway or waterway since the trusses are assembled, cladded with concrete and partially post-tensioned before being lifted and placed in an installation site.

5 Claims, 1 Drawing Sheet

METHOD OF POST-TENSIONING STEEL/CONCRETE TRUSS BEFORE INSTALLATION

CROSS REFERENCE TO RELATED APPLICATION

This application is a continuation-in-part of my copending application U.S. Ser. No. 07/708,712 filed May 31, 1991 for LONG SPAN POST-TENSIONED STEEL/CONCRETE TRUSS AND METHOD OF MAKING SAME.

BACKGROUND OF THE INVENTION

1. Field of the Invention

The present invention generally relates to a method of post-tensioning a truss of substantially conventional steel construction provided with concrete encasement or cladding of certain chords while the truss is in a fabrication yard or at ground level before erection and installation. Specifically, the invention relates to a method of making the truss as described above in which the structural steel truss is first assembled in a fabrication yard with certain of the chord being provided with formwork. Reinforcing steel and steel tendons are placed in the formwork and concrete is poured to encase the chords of the truss, the reinforcing steel and steel tendons while the truss is positioned horizontally or vertically in the fabrication yard or at ground level. The steel tendons are then partially or fully post-tensioned to provide maximum load support capability. The cladded and partially or fully post-tensioned truss are then lifted to an installation point and a load deck placed on the truss with final post tensioning of the truss then being completed. The truss of the present invention can be used in situations where trusses are used to carry heavy loads over long spans such as bridges, stadiums, convention halls and the like and is especially beneficial when spanning a busy highway or waterway since the trusses are assembled, cladded with concrete and partially post-tensioned before being lifted and placed in an installation site.

2. Description of the Prior Art

Various types of trusses are well known with the trusses being supported in various manners to produce tension or compression forces in the components of the truss. It is also well known to encase or clad certain of the components of the truss in concrete for increasing the strength, insulation and fireproofing of the truss. In my above-mentioned copending application, a truss is erected at the installation site and formwork is associated with the components of the truss to be encased in concrete with the concrete cladding having reinforcements and steel tendons for post-tensioning with the cladding and post-tensioning being accomplished after the truss is at the installation site. However, prior truss structures do not include the concept of encasing the top and bottom chords or other components of the truss in concrete in the fabrication yard or at ground level prior to being placed at the installation site and then partially or fully post-tensioning the steel tendons while the truss is either in a vertical or horizontal position. The completed and cladded truss that is partially or fully post-tensioned then is lifted or otherwise placed in an installation site and a load deck or other load is placed thereon with the truss then being final post-tensioned.

SUMMARY OF THE INVENTION

An object of the present invention is to provide a method of forming a truss constructed of steel with reinforced concrete encasement or cladding of the top and bottom chords with the cladding being reinforced and provided with steel tendons in which the truss is assembled or formed in a fabrication yard or at ground level and the concrete cladding is combined with the truss at the fabrication yard or at ground level either in a horizontal or vertical position with the steel tendons then being partially or fully post-tensioned before erection and installation of the truss at an installation site.

Another object of the invention is to provide a method of making a truss in which the steel truss is first formed and assembled in a fabrication yard and formwork is associated with certain of the components to enable concrete to be poured to encase or clad the desired components of the truss, especially the top and bottom chords with reinforcement and steel tendon being arranged in the formwork prior to pouring concrete to reinforce and strengthen the truss with the reinforced concrete having the steel tendons positioned therein being partially or fully post-tensioned by using conventional post-tensioning techniques before the truss is lifted to a installation point thereby materially reducing the time necessary to construct and install the truss while increasing the strength and rigidity of the truss.

A further object of the invention is to provide a truss and method in accordance with the preceding objects in which the cladded truss which has been partially or fully post-tensioned is lifted to an installation site and a load deck supported thereon with the truss then being final post-tensioned.

Still another object of the invention is to provide a truss and method of making the same in which the truss is constructed of a steel frame having the top and bottom chords thereof encased in reinforced concrete with post-tensionable steel tendons therein which can be partially or fully post-tensioned prior to installation of the truss at an installation site and then finally post-tensioned after the truss installation to enable more efficient truss formation and installation especially in cold climate conditions.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
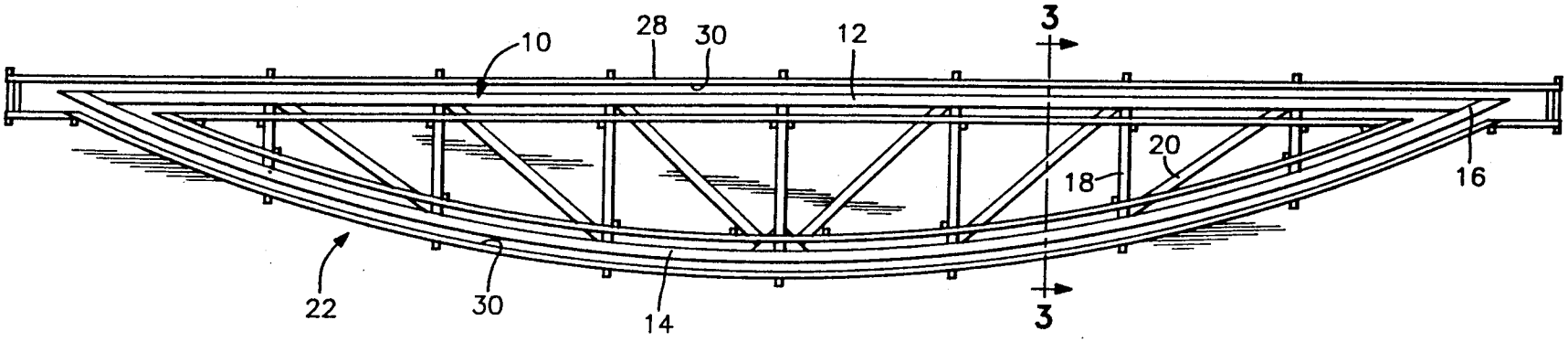
FIG. 1 is a top plan view illustrating a truss structure of steel having a curved bottom chord and a straight top chord interconnected by vertical and diagonal braces with formwork associated with the top and bottom chords.

Referring now to the drawings, FIG. 1 illustrates a plan view of a horizontally disposed conventional truss formed in a fabricating yard and oriented at ground level. The truss 10 is constructed of steel and includes a straight top chord 12, a bottom chord 14 rigidly connected at their ends at 16 and provided with vertical bracing 18 and diagonal bracing 20. The components of the truss 10 are preferably relatively lightweight steel I-beams or other suitable structural shapes with the components being rigidly interconnected by conventional fastening arrangements such as bolts, welding or the like. The length of the truss as well as its specific configuration thereof may be varied.

Figure 3:
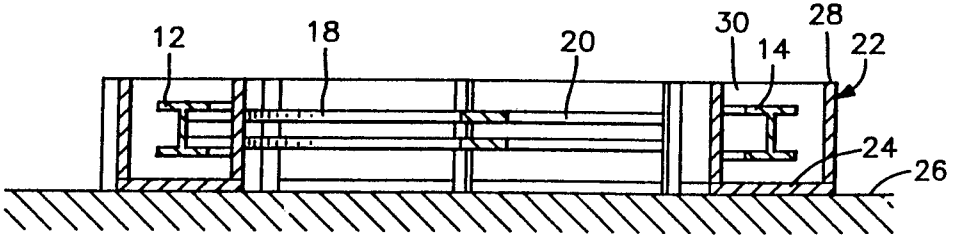
FIG. 3 is a transverse, sectional view taken along section line 3—3 on FIG. 1 illustrating the formwork supported in relation to the truss.

FIGS. 1 and 3 illustrate the first steps in the method of the present invention in which the truss 10 is assembled or formed in a fabrication yard and is oriented horizontally as illustrated or vertically if desired. The top and bottom chords 12 and 14 are provided with formwork 22 including a bottom panel 24 resting on a support surface 26 and upstanding side walls 28 defining an open top 30. Reinforcement 32 and a plurality of steel tendons 34 are placed in the formwork to support the truss in a generally centrally oriented position within the formwork.

Figure 2:
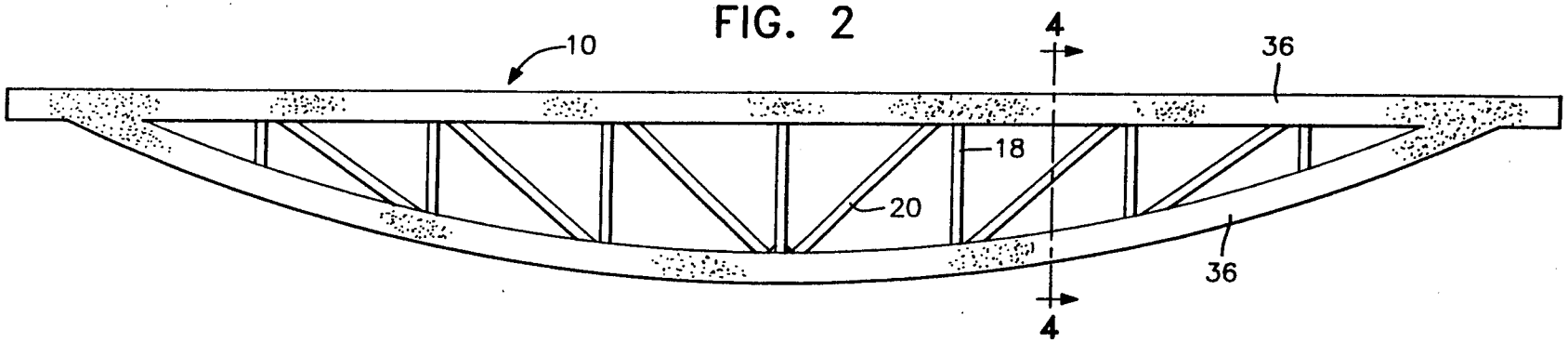
FIG. 2 is a top plan view similar to FIG. 1 illustrating the truss with the top and bottom chords encased in concrete.
Figure 4:
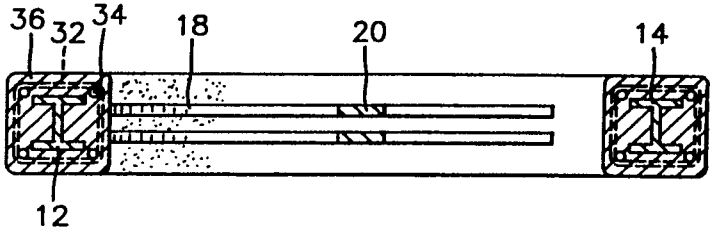
FIG. 4 is a transverse, sectional view taken along section line 4—4 on FIG. 2 illustrating the structure of the truss including the reinforced concrete cladding encasing the top and bottom chords.

Concrete 36 is poured into the formwork 22 to completely enclose and clad the top and bottom chords 12 and 14 as well as the reinforcement 32 and the steel tendons 34. FIG. 2 illustrates the cladded truss in which the top and bottom chords are encased or cladded in concrete 36.

The concrete and chords 12 and 14 are partially or fully post-tensioned by tensioning the steel tendons in a well known manner thus increasing the strength characteristics of the truss. This procedure enables the truss to be formed and the cladding concrete 36 to be applied to the chords in the fabrication yard or at ground level prior to the truss being lifted to an installation site thereby greatly facilitating the formation of the cladded truss since the application of the cladding concrete to the truss chords is done at or adjacent ground level thus simplifying the association of the formwork with the truss chords, simplifying the installation of the reinforcements and steel tendons, simplifying the pouring of concrete into the formwork and simplifying initial or partial post-tensioning of the steel tendons.

The truss which has been post-tensioned at the fabrication yard or at ground level is then transported, lifted or otherwise placed into an installation site and a load such as a load deck is then supported on or from the truss. After the load has been applied to the truss, the steel tendons in the concrete cladding in the chords is finally post-tensioned to provide desired strength characteristics to the truss. With this method, the only procedure that is necessary after installation of the truss at the installation site is final post-tensioning of the steel tendons. The construction, cladding and partial post-tensioning of the truss at ground level and finally post-tensioning the truss after installation substantially reduces the time and effort required as compared to first erecting the truss at an installation site and then placing formwork around the truss components and then placing the reinforcement and steel tendons therein and pouring concrete into the formwork while the truss is at an elevated installation site or the like. This is quite significant when supporting trusses are being installed in cold climate areas or in adverse weather conditions and also in situations where environmental surroundings are not conducive to ready access to an elevated truss installation site such as when building bridges across waterways and the like. By reducing the time spent at the actual installation site, exposure of workers to adverse weather conditions is reduced and reduction in the time that workers are engaged in activities at elevated positions is also reduced thereby increasing the safety factor for the workers.

The steel tendons, when post-tensioned, add substantial strength to the truss since they have an ultimate tensile strength of 270,00 psi as compared to ordinary structural steel that has a yield strength ranging from 36,000 to 50,000 psi. The two-step post-tensioning of the steel tendons reduces any sag that may result in a long span heavily loaded truss and the concrete cladding increases structural stiffness thereby providing maximum load supporting capability for maintaining costs at a minimum.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. The method of forming a steel/reinforced concrete cladded truss, said truss being formed in a fabrication yard at ground level and comprising an elongated bottom chord, an elongated top chord spaced from the bottom chord, a plurality of braces interconnecting the top and bottom chords to form a rigid truss, said chords and braces being constructed of steel, said method consisting of steps of encasing said top and bottom chords with concrete cladding with the concrete cladding completely enclosing the top chord and bottom chord, said concrete cladding including steel reinforcement and steel tendons embedded in the concrete cladding enclosing the chords prior to the concrete cladding hardening, said step of encasing the top and bottom chords with concrete consisting of the step of associating formwork with the top and bottom chords of the truss, said step of including steel reinforcement and steel tendons in the concrete cladding consisting of the steps of placing steel reinforcement and steel tendons in said formwork, pouring concrete in said formwork, allowing the concrete to harden and post-tensioning and steel tendons.

2. The method as defined in claim 1 together with the steps of lifting the cladded, post-tensioned truss to an installation site, applying a load to the truss and finally post-tensioning said steel tendons.

3. The method as defined in claim 2 wherein the step of associating formwork with said chords includes positioning the truss in a horizontal position with the chords positioned in the formwork by moving the chords vertically downwardly through an open top of the formwork thereby enabling association of the formwork with the chords after the formwork has been preconstructed at ground level.

4. The method of constructing a steel truss with components cladded in concrete prior to installation at an installation site comprising the steps of assembling the steel truss in a fabrication yard, placing an open-topped formwork in partial enclosed relation with certain components of the truss, placing steel tendons and reinforcing steel in said formwork, filling the formwork with concrete, permitting the concrete to harden and post-tensioning said steel tendons before moving the truss to an installation site.

5. The method as defined in claim 4 wherein said step of post-tensioning includes only partial post-tensioning of the steel tendons, said method also including the step of final post-tensioning of the steel tendons after the truss has been moved to an installation site and loaded.

* * * * *

UNITED STATES PATENT AND TRADEMARK OFFICE

CERTIFICATE OF CORRECTION

PATENT NO. : 5,299,445

DATED : April 5, 1994

INVENTOR(S) : Alfred A. YEE

It is certified that error appears in the above-indentified patent and that said Letters Patent is hereby corrected as shown below:

Column 1, line 24, cancel "chord" and insert --chords--.
Column 2, line 26, cancel "a" and insert --an--.
Column 4, Claim 1, line 37, before "steps" insert --the--;
line 50, cancel "and" (second occurrence) and insert --said--.

Signed and Sealed this

Seventeenth Day of October, 1995

*Attest:*

Bruce Lehman

BRUCE LEHMAN

*Attesting Officer*

*Commissioner of Patents and Trademarks*